United States Patent [19]

Brashier

[11] Patent Number: 5,072,858

[45] Date of Patent: Dec. 17, 1991

[54] DIVIDED BEVERAGE SERVER

[76] Inventor: James W. Brashier, 1654 Creekside, Sugar Land, Tex. 77478

[21] Appl. No.: 638,476

[22] Filed: Jan. 4, 1991

[51] Int. Cl.[5] ..... A47G 19/12; B65D 5/60

[52] U.S. Cl. ..... 222/144.5; 222/470; 222/472; 222/517

[58] Field of Search ..... 222/129, 144.5, 145, 222/475.1, 470–474, 142.6–142.9, 511, 515, 516, 517

[56] References Cited

U.S. PATENT DOCUMENTS

| | | | |
|---|---|---|---|
| 869,702 | 10/1907 | Friend | 222/144.5 |
| 1,025,653 | 5/1912 | Sims | 222/144.5 |
| 1,312,203 | 8/1919 | Picard | 222/129 |
| 1,472,007 | 10/1923 | Jones | 222/129 |
| 2,187,927 | 1/1940 | Ayotte | 222/470 |
| 2,236,786 | 4/1941 | Ayotte | 222/470 |
| 4,651,900 | 3/1987 | Horvath et al. | 222/144.5 |
| 4,703,871 | 11/1987 | Broker | 222/144.5 |
| 4,750,644 | 6/1988 | Kolody | 222/144.5 |
| 4,773,563 | 9/1988 | Taylor | 222/472 X |
| 4,802,406 | 2/1989 | Bouldin | 222/129 X |

FOREIGN PATENT DOCUMENTS

| | | | |
|---|---|---|---|
| 2612157 | 9/1988 | France | 222/144.5 |
| 1325007 | 8/1973 | United Kingdom | 222/144.5 |

*Primary Examiner*—Kevin P. Shaver

*Attorney, Agent, or Firm*—William E. Shull; David A. Rose

[57] ABSTRACT

A beverage server has a divided fluid container comprising a pair of isolated chambers. The container has mounted thereon a closure cap of a cap assembly which locks to the top of the container. The closure cap has filler caps on its upper face for alternately exposing the chambers to permit filling them with beverages to be dispensed, and closing off the chambers from the outside. The cap assembly houses a chamber selection mechanism for alternately selecting one or the other of the chambers from which to dispense a beverage. The chamber selection mechanism includes a trigger housed in the handle which actuates a rack and pinion assembly housed in the closure cap. A pinion rod and chamber plug carrier arm mounted thereon rotate as the pinion gear is engaged by the rack. A chamber plug carried by the arm is rotated as desired into position for alternately opening up or closing off one of the two chambers. A compression spring operates to move the chamber selection mechanism to a default position, sealing off one of the two chambers and permitting the other chamber to communicate with the common spout. When the trigger is depressed, the spring is loaded, at the same time opening up the one chamber and closing off the other. When the trigger is released, the loaded spring moves to its relaxed state and returns the chamber selection mechanism to the default position.

4 Claims, 5 Drawing Sheets

DIVIDED BEVERAGE SERVER

BACKGROUND OF THE INVENTION

The present invention relates generally to beverage servers, and more particularly to a divided beverage server which can be used to store and serve beverages of two different types if desired.

The increasing health consciousness of people today has led to an increased popularity of decaffeinated coffee, diet and/or decaffeinated soft drinks, health food beverages, and the like. This proliferation of the types of beverages people now enjoy has led to the need for restaurants, caterers, and even those entertaining in their homes to provide a plurality of different containers for storing and serving these beverages. For example, in most restaurants of late, waiters and waitresses have had to carry two containers of coffee for their patrons, one for "regular" or caffeinated coffee, and another for decaffeinated coffee. This often inconveniences the server, because he or she often does not have a free hand to attend to other needs of the customers or other tasks. In some establishments, notably in the more exclusive clubs and the like, the waiters and waitresses are prohibited from carrying more than one beverage server at a time, a rule that makes sense not only from a job safety standpoint, but also with respect to maintaining the proper atmosphere or ambience of the establishment. Many times extra trips to the coffee station or kitchen are required in order to provide the patrons with the desired beverage. This not only increases the cost to the restaurant owners of providing the service, but also tends to inconvenience the customers whose needs are not immediately met.

It is an object of the present invention to solve the problem referred to above by providing a divided beverage server which will enable the server to dispense two different beverages from the same container. It is another object of the present invention to provide such a divided beverage server which is reliable, inexpensive to manufacture, and safe and efficient to use.

SUMMARY OF THE INVENTION

In accordance with the invention, a beverage server is provided which has a divided fluid container comprising a pair of chambers which are isolated from one another. The divided fluid container has a pair of upwardly extending necks each of which communicates with one of the chambers and which are received in separate bores in a closure cap of a cap assembly which locks to the top of the container. The closure cap has filler caps on its upper face for alternately exposing the bores of the closure cap to permit filling the chambers with beverages to be dispensed, and closing the bores to prevent spillage or contamination of the contents during storage or serving of the beverages. The cap assembly includes a handle and an extension portion for housing, along with the closure cap, a chamber selection mechanism for alternately selecting one or the other of the chambers from which to dispense a beverage. The chamber selection mechanism includes a trigger housed in the handle which actuates a rack and pinion assembly housed in the closure cap. A pinion rod of the rack and pinion assembly has mounted thereon a chamber plug carrier arm which rotates as the rod is rotated by engagement of the pinion gear by the rack. A chamber plug carried by the arm is rotated as desired into sealing engagement with one of two apertures between a common spout for the two chambers, and the respective one of a pair of central recesses in the closure cap which are in communication with one of the two chambers. A compression spring operates to move the chamber selection mechanism to a default position, sealing off one of the two chambers and permitting the other chamber to communicate with the common spout. When the trigger is depressed, the spring is loaded, at the same time opening up the one chamber and closing off the other. When the trigger is released, the loaded spring moves to its relaxed state and returns the chamber selection mechanism to the default position.

These and other objects and advantages of the invention will be apparent from the following description, read in conjunction with the reference to the attached drawings wherein:

DESCRIPTION OF THE PREFERRED EMBODIMENT OF THE INVENTION

Figure 2:
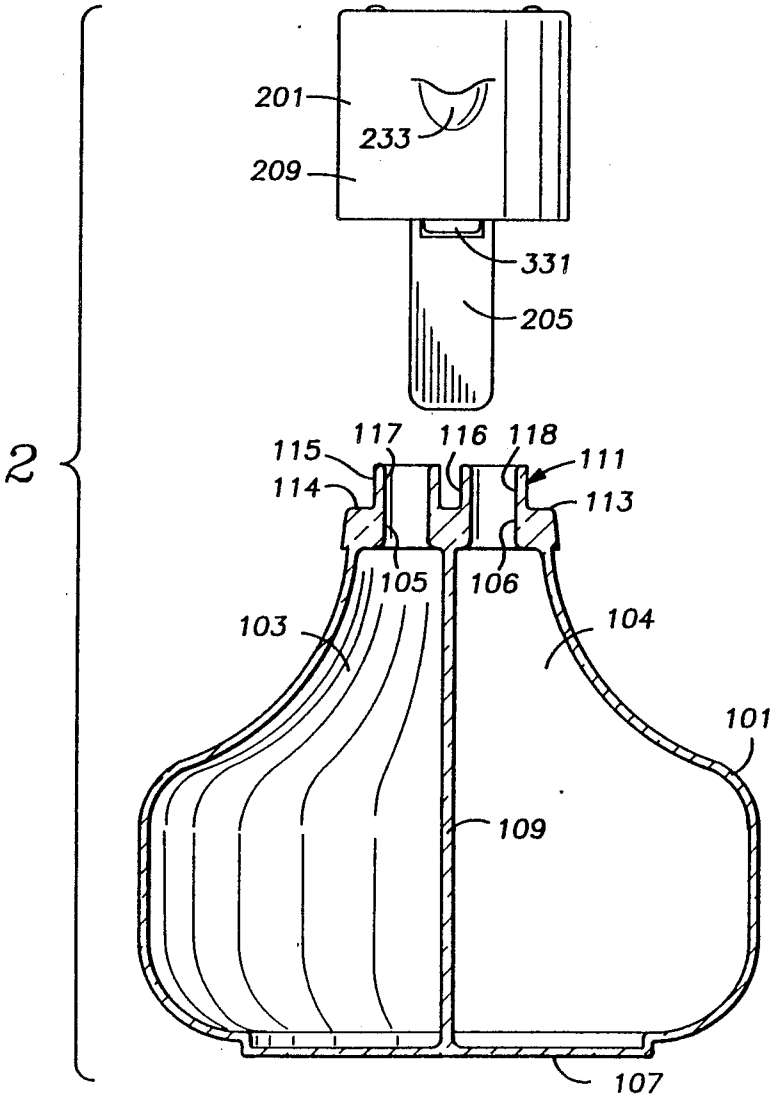
FIG. 2 is a front vertical sectional view of the divided beverage server according to the invention, with the cap assembly removed from the divided fluid container.
Figure 1:
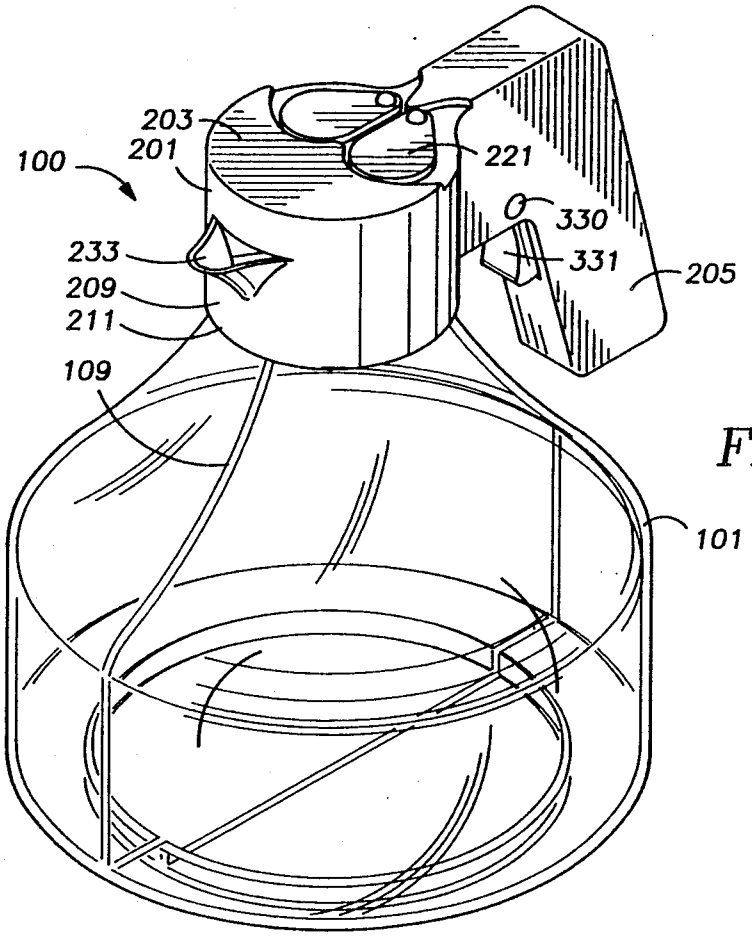
FIG. 1 is an isometric view of a divided beverage server according to the invention.

Referring initially to FIG. 1, the divided beverage server of the present invention is indicated generally at 100. Divided beverage server 100 generally includes a bottom portion comprising a divided fluid container 101, a top portion comprising a cap assembly 201, and a chamber selector mechanism 301 carried by and substantially entirely within the cap assembly 201. The divided fluid container 101 includes a pair of chambers 103, 104 for containing a liquid or liquids, each chamber having a liquid passage 105, 106, respectively, at its upper end for communicating liquids into or out of the chambers. Cap assembly 201 fits tightly onto the upper portion of divided fluid container 101, and chamber selector mechanism 301 operates to alternatively select one or the other of chambers 103, 104 from which to pour the liquid contents, if any, of the selected chamber into another container such as a glass, cup, bowl, or the like, if desired.

Divided fluid container 101 may comprise a pot, carafe, jug, bottle, jar or similar container, and may be made of metal, plastic, glass, porcelain, clay, or other material suitable for containing, storing, and/or serving potable liquids or fluids. Container 101 may be clear, translucent, or opaque. Use of clear plastic or glass would be advantageous in that the server and/or recipient can see the contents from without the container. That is important for the server, for example, since he or she is able to see how much of the original contents are left in the respective chambers, which of course enables the server better to judge when refilling is necessary. From the standpoint of both the server and the recipient, another advantage of having the container made of clear glass or plastic may be that the server is better able to make suggestions, and the recipient, if other than the server, is better able to make choices as between the liquids contained in the divided beverage server. Other materials than clear plastic or glass could, of course, be used advantageously; a color scheme for an opaque container for decorating purposes might even be preferred in some cases.

Divided fluid container 101 typically has a base 107 for resting the container on a flat surface, such as a hot plate, table, countertop, or the like. Chambers 103, 104 are divided by an integral wall 109 which is disposed substantially vertically when the container 101 is upright and extends diametrically across the container. Wall 109 may divide container 101 into equal, or unequal, chambers 103, 104. Container 101 has on its upper end a liquid communication portion 111 of reduced outside diameter, and having a cap plate 113 of generally flat, circular cylindrical shape disposed at the upper ends of chambers 103, 104 and a pair of liquid passage coupling necks 115, 116 projecting upwardly from the upper face 114 of cap plate 113. Liquid passage coupling necks 115, 116 are generally circular cylindrical tubular in shape with a rounded lip on their upper terminal ends. Coupling necks 115, 116 have fluid-carrying bores 117, 118, respectively, therethrough which communicate with liquid passages 105, 106, respectively, disposed through cap plate 113. Accordingly, fluids may pass into or out of chambers 103, 104 through passages 105, 106 and bores 117, 118, respectively. The passages 105, 106 may also be provided with a rounded lip where they intersect the lower face of cap plate 113. The lower, outer circumferential edge of cap plate 113 comprises a radially outwardly projecting, downwardly facing lip 119 adapted for locking engagement with cap assembly 201 as hereinafter set forth. The outer side wall 120 of cap plate 113 may be tapered upwardly to facilitate placement of cap assembly 201 onto container 101. If a sufficiently flexible material is used for cap assembly 201, however, such tapering may not be necessary.

Cap assembly 201 generally comprises a closure and selection cap 203, a handle 205, and an extension portion 207 connected therebetween. Closure and selection cap 203 is adapted for releasable locking engagement with the upper or liquid communication portion 111 of divided fluid container 101. Cap 203 includes a generally circular cylindrical body 209 with a downwardly projecting, circumferentially extending skirt 211 around its lower end for telescoping insertion over the upper end of container 101. Skirt 211 has a rounded nose 212 on its lower terminal end, which forms a radially inwardly projecting, upwardly facing annular locking flange 213. Nose 212 is adapted to slide down over cap plate 113 when pressed thereon, and locking flange 213 snaps into locking engagement with lip 119 on container 101. Cap assembly 201 is provided with a pair of transversely extending bores 215 into which liquid passage coupling necks 115, 116 are inserted when cap 203 is snapped into place on container 101. A pair of seals 217, such as O-rings, are carried within annular grooves in the walls of bores 215 and sealingly engage necks 115, 116.

Figure 3:
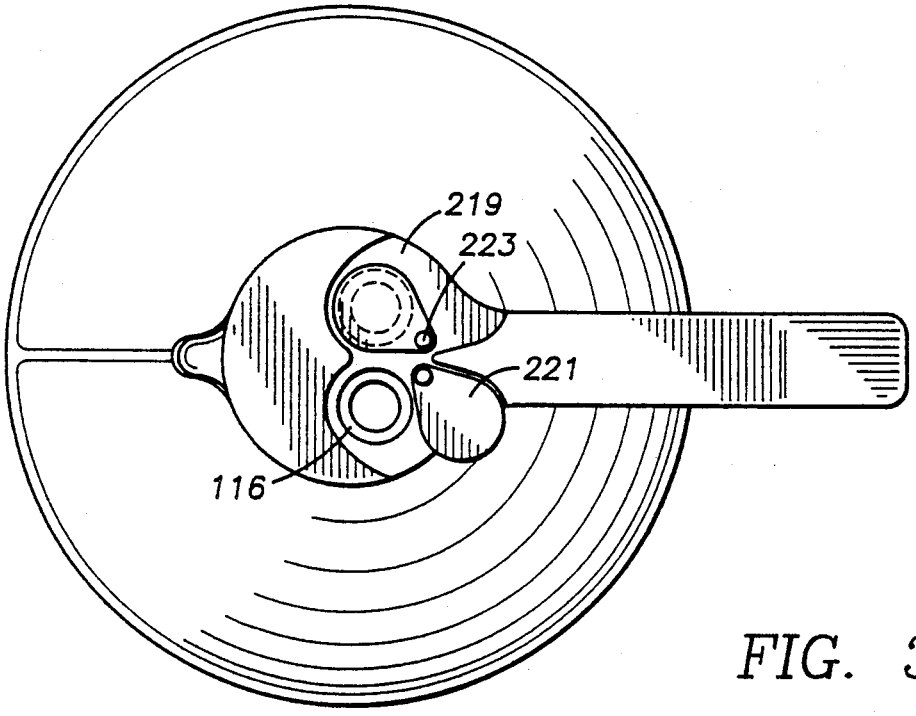
FIG. 3 is a plan view of the divided beverage server according to the invention.
Figure 4:
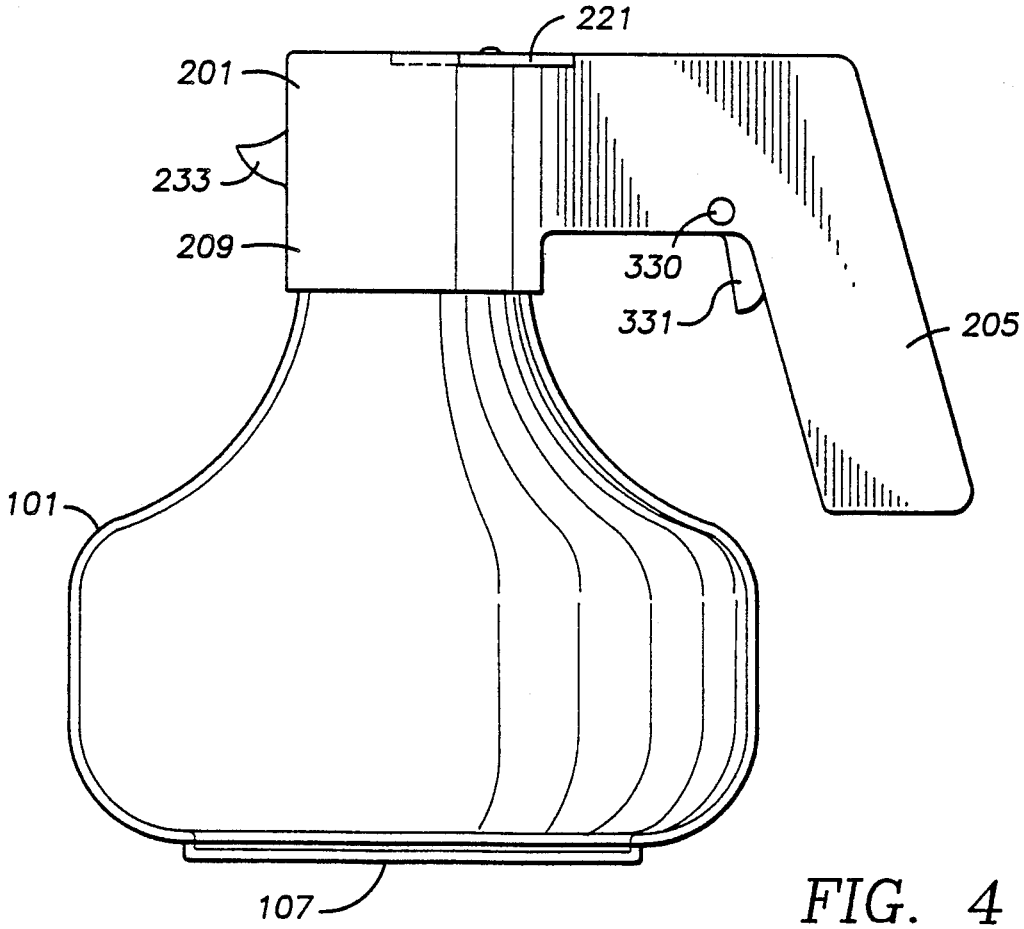
FIG. 4 is a side elevational view of the divided beverage server according to the invention.

The upper face of body 209 includes a recessed portion 219 for carrying a pair of filler caps 221. Filler caps 221 are pivotably pinned to the recessed upper face of body 209 with pivot pins 223. Cap body 209 includes a second pair of transversely extending bores 225 which lead from recessed upper portion 219, each one to one of a pair of isolated central cavities 227, 228 (FIGS. 6 and 8) disposed between bores 215 and bores 225. Filler caps 221 comprise relatively thin, flat plates or discs adapted for sealingly covering or uncovering, as the case may be, the upper terminal ends of bores 225. As shown, for example, in FIG. 3, filler caps 221 may be rotated about pins 223 within the extent permitted by recess 219 to cover, for example, neck 115 or expose, for example, neck 116. When uncovered, i.e., with cap 221 in a position like the lower one shown in FIG. 3, neck 115 or 116 may be used to fill the reservoir of the respective chamber with the liquid to be dispensed. When closed, i.e., with cap 221 in a position such as the upper one shown in FIG. 3, filling is prevented. Caps 221 are adapted to close tightly enough to substantially prevent spillage out of cap 203 when caps 221 are in a closed position.

Each central cavity 227, 228 communicates with a common pour spout recess 231 within the cap 203 by means of a circular aperture 232, 234, respectively (FIGS. 6, 8), disposed in the back wall of the recess 231. The front of the recess 231 communicates with a common pour spout 233. Apertures 232, 234 provide means for communicating liquids from the cavities 227, 228 to the common pour spout 233. As described below, the chamber selector mechanism 301 includes means for selectively closing off one or the other of apertures 233, 234 to isolate the respective cavity 227, 228, and hence the connected chamber 103, 104, from the pour spout 233.

The upper portion of the cap 203 of the cap assembly 201, the extension portion 207 thereof, and the handle 205 comprise substantially solid, rigid members having recesses as follows for accommodating parts of the chamber selector mechanism. The cap 203 includes a rack and pinion recess 236 disposed substantially in the center of the cap above the pour spout recess 231. Recess 236 has an elongate portion for accommodating a rack 303, and a cylindrical portion intersecting it for accommodating a pinion 305 which engages the rack. See FIGS. 5–8. At the front end of the recess 236 there is a thin circular bore 238 which extends nearly to the front wall of the cap 230 for receiving and centralizing a pinion actuating rack front extension arm 307. Front extension arm 307 attaches to the rack 303. At the rear of recess 236 a small circular aperture leads to an elongate recess 240 which extends from the cap 203 into the extension portion 207 of the cap assembly for accommodating a pinion actuating rack rear extension arm 309 and default spring 311 of the chamber selector mechanism. Rear extension arm 309 extends through the aperture between recesses 236, 240 and connects to the rack 303. Recess 240 extends into a enlarged recess 242 in the extension portion 207 and handle 205 for accommodating the chamber selector trigger 313 and the linkage 315 to the rear extension arm 309 of the chamber selector mechanism. At the rear of the recess 242 in the handle 205 there is a thin circular bore 244 which extends through the rear surface of the handle 205 for receiving and centralizing the pinion actuating rack rear extension arm 309.

The chamber selector mechanism 301 includes a pinion rod 317 disposed in a vertically (again, with reference to the device in the upright position) extending blind bore in the cap 203. Rod 317 carries pinion gear 305 thereon. Rod 317 is sealed to the cap 203 above the spout recess 231 by an O-ring 321 or the like. A plug carrier arm 323 is attached to the rod 317 near its lower end, and is disposed in the spout recess 231. The plug carrier arm 323 has double-sided, elastomeric (e.g., rubber or the like) chamber plug 325 disposed thereon near its free end. The chamber plug 325 has an exposed sealing surface on each side of the carrier arm with a configuration on each such side which is correlative to the apertures 232, 234 and sealingly engageable therewith. Rod 317 is free to rotate about its longitudinal axis to a limited extent, and when rotated to its fullest extent in either a clockwise or counterclockwise direction, plug 325 sealingly engages one or the other of the apertures 232, 234.

Pinion 305 is actuated by the axial movement of rack 303, which has teeth engageable with those on the pinion. Rack 303 is free to move axially to a limited extent in recess 236. Front and rear extension arms 307, 309, which are connected to the rack 303, are relatively confined in bores 238, 244, thus stabilizing and centralizing the axial movement of the rack.

Trigger mechanism 313 is attached by means of pivot pin 330 within handle 205. By depressing the actuating arm 331 of trigger 313, the trigger will tend to rotate about pivot pin 330, thereby causing the upper or linkage end 315 to move in a counterclockwise direction. Trigger 313 is attached to rear extension arm 309 by means of the free floating linkage 315, which enables the circular movement of the linkage end of the trigger to translate to axial movement of the arm 309 and attached rack 303. Axial movement of the rack 303 effects rotation of the pinion 305 and shaft 317 attached thereto, which in turn swings the plug carrier arm one way or the other, permitting the chamber plug to engage one of the apertures 232, 234 to seal it.

Figure 8:
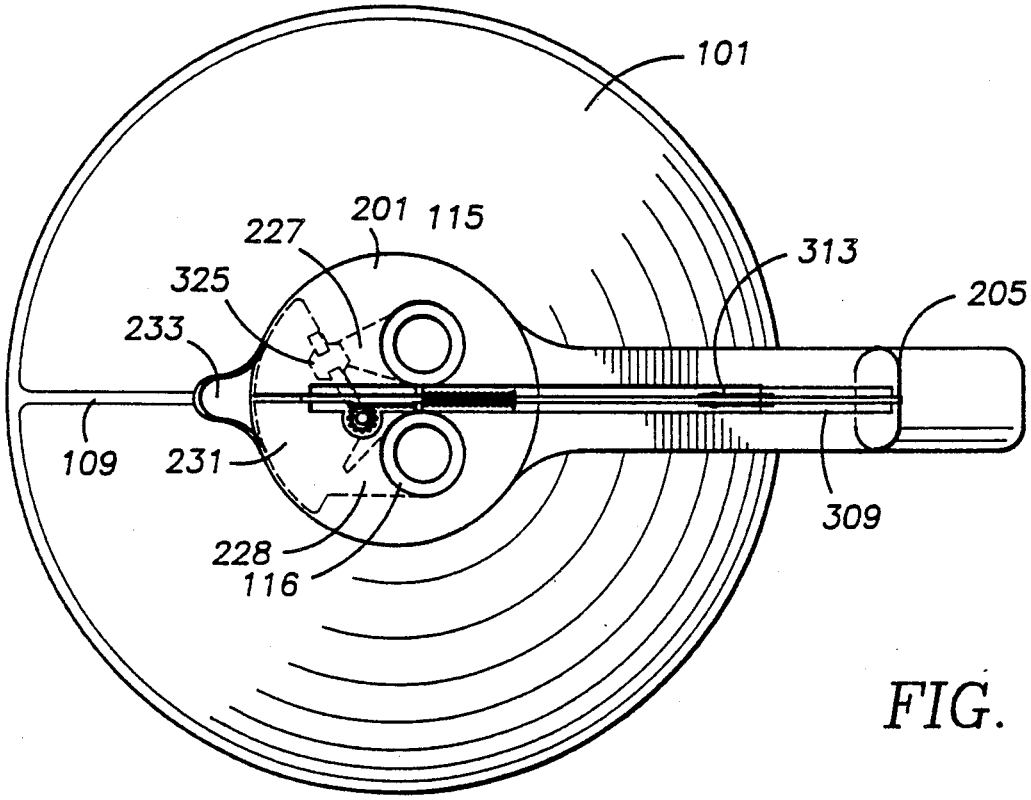
FIG. 8 is a plan view, partly in horizontal section, of the apparatus of the present invention in the default position shown in FIG. 7.
Figure 7:
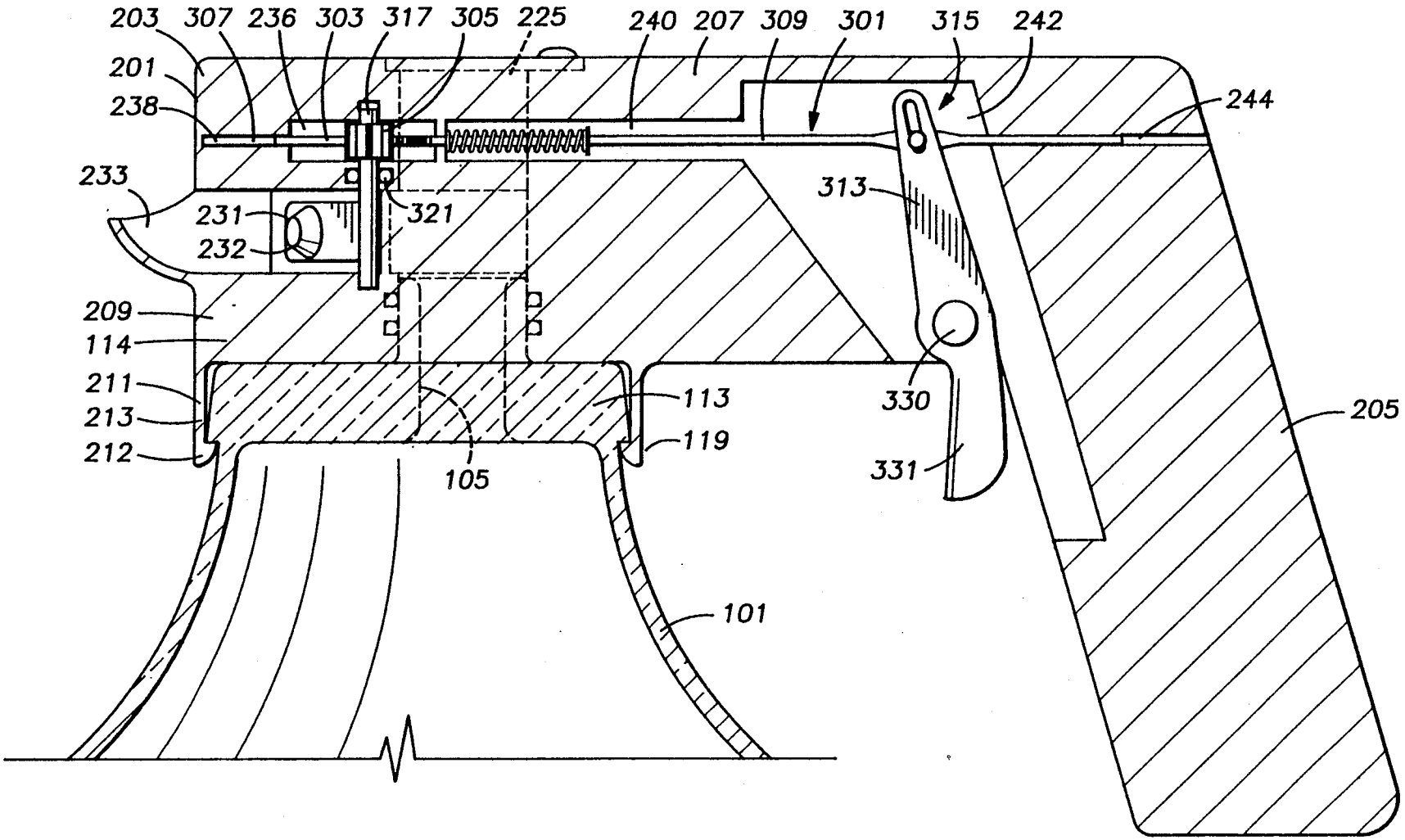
FIG. 7 is an enlarged, fragmentary view of the top of the divided fluid container, the cap assembly and the chamber selection mechanism of the divided beverage server according to the invention, with the trigger in the default position.

A default spring 311 is attached to the rear extension arm 309 and fixed between its point of attachment and the front end of the recess 240. In the relaxed state shown in FIG. 7, the spring is extended, and urges the rod 309 rearwardly. This in turn urges the upper or linkage end of the trigger toward the rear of the handle, and the lower end of the trigger is consequently urged forwardly. In this position, the plug 325 seals aperture 232 as shown in FIGS. 7 and 8. Thus, the default position of the selection mechanism opens chamber 104 for passage of liquids to spout 233 while closing off chamber 103.

Figure 5:
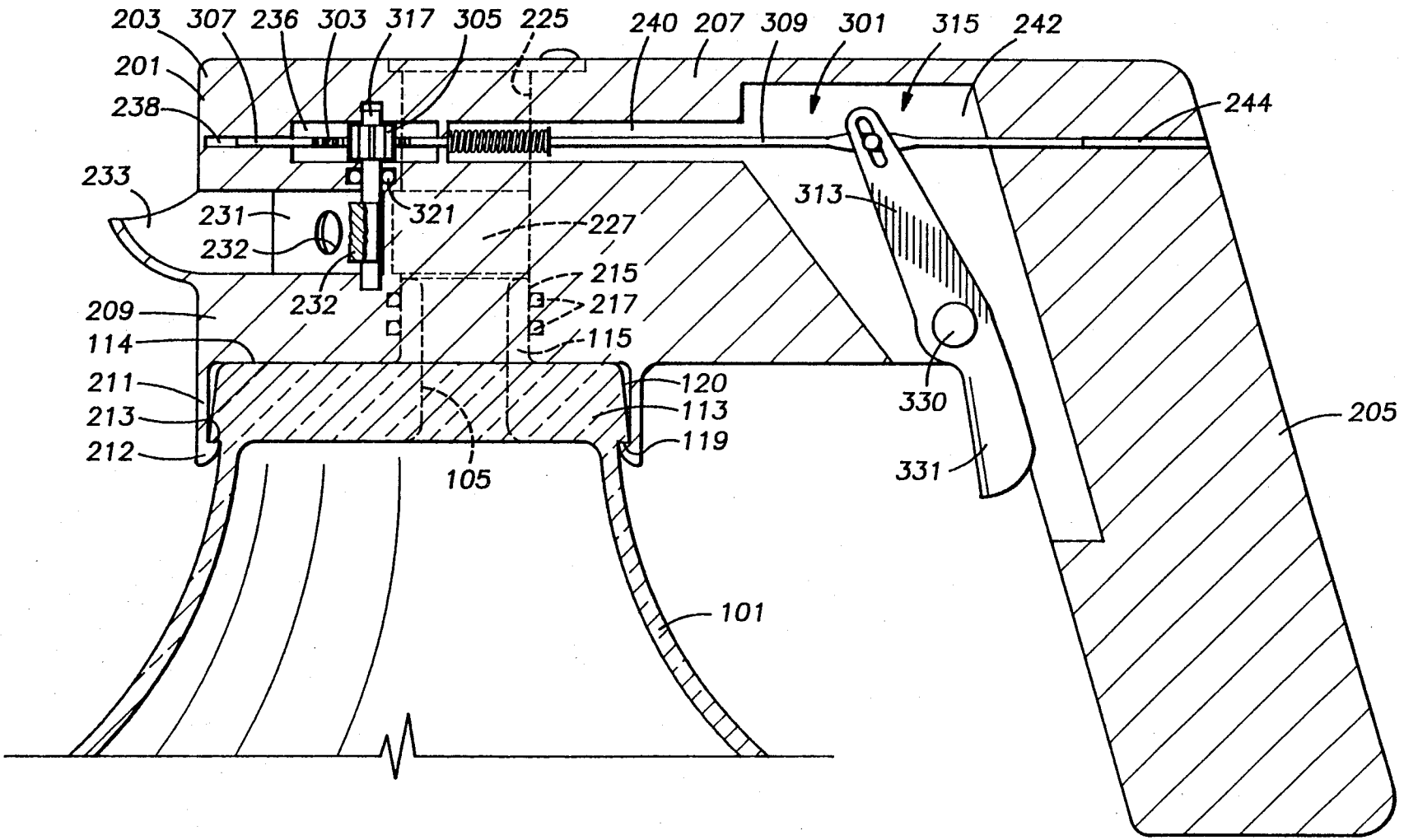
FIG. 5 is an enlarged, fragmentary view of the top of the divided fluid container, the cap assembly and the chamber selection mechanism of the divided beverage server according to the invention, with the trigger depressed to the active position.
Figure 6:
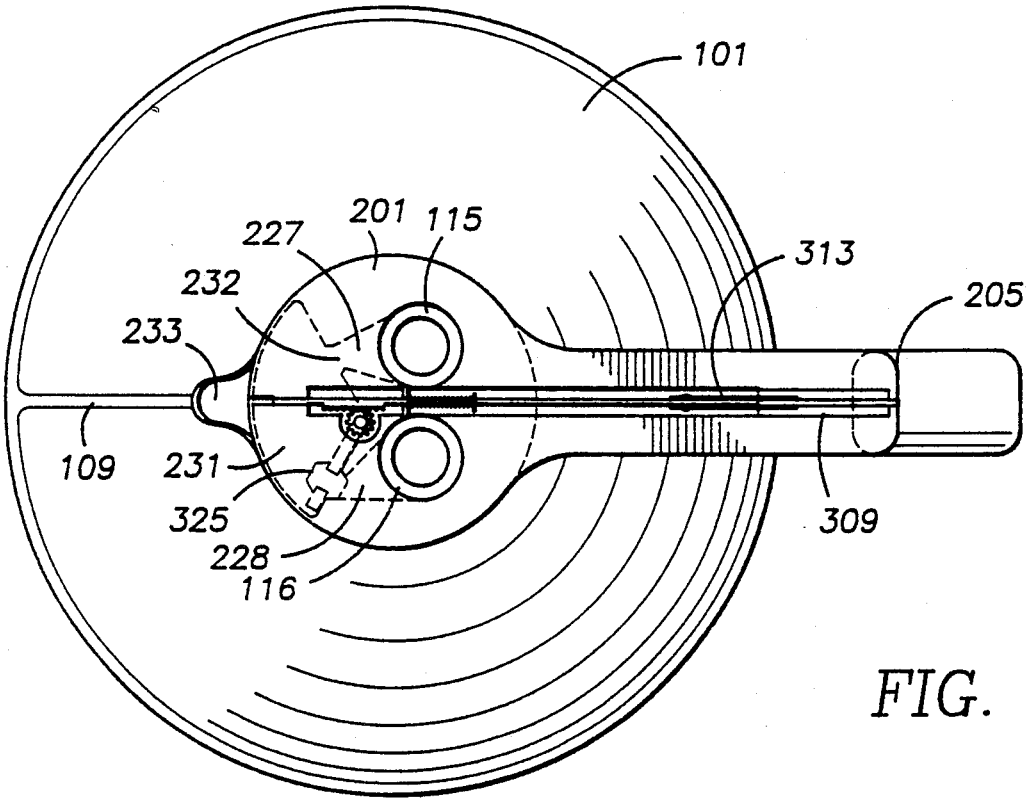
FIG. 6 is a plan view, partly in horizontal section, of the apparatus of the present invention in the active position shown in FIG. 5.

When the trigger arm 331 is depressed as shown in FIGS. 5 and 6, the arm 309 is pushed forwardly, compressing the spring 311, and moving the rack axially so that the plug carrier arm swings the chamber plug into sealing engagement with aperture 234, thus sealing off chamber 104 and opening chamber 103 to communication with the spout 233. When the trigger is released again, the spring returns to its extended default position described above, again opening chamber 104 and sealing chamber 103. As can be seen, by simply depressing the trigger or not, the server can select which of the liquids contained in chambers 103, 104 will be dispensed.

The present invention can be used to dispense either hot or cold beverages, and thus can be provided with appropriate insulative means known in the art for keeping the beverages hot or cold. The invention will be seen to have particular utility in serving caffeinated and decaffeinated coffee, but it should be appreciated that it can also be used to dispense coffee and tea, different types of juices, soft drinks, and the like.

We claim:

1. A divided beverage server, comprising:

a fluid container having an open upper end and first and second fluid storage chambers isolated from one another and having first and second fluid passage means, respectively, open to said open upper end;

cap assembly means mounted on said open upper end of said fluid container for closing said open upper end, said cap assembly means having first and second fluid passage bores communicating said first and second fluid passage means, respectively, of said fluid container to the outside of said cap assembly means, said first and second fluid passage means communicating fluids to said first and second fluid passage bores when said fluid container is tilted, and having a common pour spout having first and second fluid dispensing aperture means in communication with said first and second fluid passage bores, respectively, of said cap assembly means for communicating fluids stored in said chambers to said common pour spout from said first and second fluid passage bores when said fluid container is tilted; and fluid storage chamber selection means housed within said cap assembly for selectively alternately closing said first fluid dispensing means and opening said second fluid dispensing means, or opening said first fluid dispensing means and closing said second fluid dispensing means, said fluid dispensing means when closed preventing fluid communication between the respective chamber and said common pour spout and said fluid dispensing means when open permitting fluid communication between the respective chamber and said common pour spout.

2. A divided beverage server according to claim 1, wherein said fluid storage chamber selection means includes a rack and pinion means housed within said cap assembly having a rack, a pinion gear engageable with said rack, and a pinion rod on which said pinion gear is mounted, said rod being rotated clockwise or counterclockwise, as the case may be, when said rack is actuated axially back and forth, said rack being actuable by a trigger means housed within a handle comprised in said cap assembly, and a plug carrier arm mounted on said rod and having a double-sided plug attached thereto for selectively sealingly engaging said first or said second fluid dispensing means when said rod is rotated.

3. A divided beverage server according to claim 2, and further including an extension arm connected between said trigger means and said rack and having spring biasing means mounted around said extension arm for biasing said rack into a default position, said double-sided plug engaging one of said fluid dispensing means in said default position.

4. A divided beverage server according to claim 3, said trigger means moving said double-sided plug into an active position in engagement with the other of said fluid dispensing means when said trigger means is depressed.

* * * * *